US005458549A

United States Patent [19]

Obery

[11] Patent Number: 5,458,549

[45] Date of Patent: Oct. 17, 1995

[54] CUSHIONED FLOOR PAD FOR EXERCISING ABDOMINAL MUSCLES

[76] Inventor: Eric J. Obery, 138 Pine St., Apt. 3, Portland, Me. 04102

[21] Appl. No.: 259,923

[22] Filed: Jun. 13, 1994

[51] Int. Cl.[6] ..... A63B 23/02

[52] U.S. Cl. ..... 482/23; 482/140; 482/142

[58] Field of Search ..... 5/419, 420, 630, 5/632, 464, 431; 482/23, 142, 140; 128/845, 869, 870; 606/240

[56] References Cited

U.S. PATENT DOCUMENTS

| | | | |
|---|---|---|---|
| D. 318,772 | 8/1991 | Phillips | 5/431 |
| 4,210,322 | 7/1980 | Pritchard | 482/23 |
| 4,336,621 | 6/1982 | Schwartz et al. | 5/466 |
| 4,350,721 | 9/1982 | Nagase | 482/23 |
| 4,365,371 | 12/1982 | Boussaroque | 5/464 |
| 4,926,512 | 5/1990 | Coyle | 5/432 |
| 5,022,107 | 6/1991 | Knotts | 5/419 |
| 5,100,130 | 3/1992 | Shoebrooks . | |
| 5,121,756 | 6/1992 | Koledin | 128/870 |
| 5,125,883 | 6/1992 | Shoebrooks . | |
| 5,169,372 | 4/1992 | Tecco . | |
| 5,211,185 | 5/1993 | Garth et al. | 128/870 |
| 5,314,395 | 5/1994 | Ciolino | 482/142 |
| 5,337,427 | 8/1994 | Pagano et al. | 5/630 |
| 5,368,537 | 11/1994 | Felice | 482/140 |

OTHER PUBLICATIONS

Ab Crunch Bench, Maxicam Catalogue, p. 11, 1993.
Abflexor, Athletic Business Magazine, p. 82, 1993, Oct.
Ab Board, SLM Fitness Catalogue, 1993.

*Primary Examiner*—Jerome W. Donnelly

[57] ABSTRACT

An exercise device comprising, an elongated sheet of flexible, resilient, cushioned material and a substantially ridgid support panel attached to the back side, which supports the head, neck and upper back of a user while performing an abdominal crunch. An attachment strap is provided, near the end of the device that recieves and supports the head, to temporarily affix a common dumbbell to the device so as to increase the resistance on the abdominal muscles. Through holes are provided on opposite sides of the head recieving end for additional gripping positions for those users who cannot or do not wish to engage the device by gripping along the perimeter edge.

6 Claims, 4 Drawing Sheets

EXPLODED VIEW

REAR VIEW

EXPLODED VIEW

EXPLODED VIEW

CUSHIONED FLOOR PAD FOR EXERCISING ABDOMINAL MUSCLES

BACKGROUND OF THE INVENTION

1. Field of Invention

This invention relates to abdominal exercise devices, specifically to such devices which can be used as a cushioned floor pad.

2. Description of Prior Art

Strengthening and toning muscles are a common goal among exercise enthusiasts. Health clubs offer classes dedicated to strengthening and toning exercises. Likewise, many exercise videos are devoted to muscle conditioning. During these classes participants often lie on a cushioned pad to do exercises for various parts of the body. These pads are made from a foam or other comfortably supportive material. The pads are inexpensive and easily portable, but have no other utility beyond their use as a cushion.

Although the classes and videos offer exercises for the entire body, an area that receives much attention is the abdominal muscles. The primary muscle that is exercised in abdominal exercises is the rectus abdominus. One function that this muscle has is to work in concert with the lower back muscles to keep the upper torso erect. Weak abdominal muscles can be one cause of a bad back.

An exercise that effectively trains the rectus abdominus is the abdominal crunch. To perform this exercise a person must lie on their back and draw their heels in towards the buttocks so their knees are bent. The movement consists of curling the trunk into a concave position so the head, neck and shoulders are slightly elevated off the floor. In this position the rectus abdominus is contracted. The person returns to the starting position thus relaxing the muscle. This sequence is repeated for several repetitions.

One physiological limitation of this and other trunk curl exercises concerns neck muscle fatigue. As this exercise is performed, the trunk and head are lifted off the floor or bench. The weight of the head is supported by the neck muscles while the exercise is being performed. If the exerciser holds their hands behind their head, some weight may be relieved from the neck.

After performing many repetitions, neck muscle become fatigued from supporting the weight of the head. Stiff or sore neck muscles can result which may dissuade the exerciser from continuing the regime. Holding the hands behind the head does relieve some stress on the neck, but as the abdominal muscles fatigue some exercisers begin to pull up with their hands to help complete the repetitions. Pulling on the head can put more stress on the neck and may result in a injury to the neck.

Another limitation of trunk curl exercises is the lack of a safe, comfortable and convenient way to add external resistance. Increasing the resistance the abdominal muscles must overcome to elevate the head, neck and upper back, increases the intensity on the abdominal muscles. The increased effort is beneficial in that it results in a greater strengthening and toning effect on the abdominal muscles.

Several types of abdominal exercise boards have been developed where the user lies supine on the board with the feet or knees secured and the hands interlocked behind the head. While the user lies on the flat or slanted board, it provides support and cushioning. Once the user begins to do an abdominal crunch, the head can be only partially supported by the hands. The only way to add external resistance is to place a weight either behind the head or on the chest of the exerciser. These methods are awkward, uncomfortable and upper back. The user grabs the handles that are mounted on the section of the board that their bulk and weight. One device has been developed that is portable and inexpensive, but it suffers from the other disadvantages listed above.

A few types of abdominal exercise devices have been developed to support either the head and neck or the head, neck and upper back during abdominal exercises. U.S. Pat. No. 5,169,372 to Tecco (1992) discloses a device that receives and supports the user's head and neck during trunk curl exercises. This device does not support the upper back so it is possible for the user to pull their head past the plane of the upper back which may cause neck pain. The device cannot be used for a cushion while performing exercises for other parts of the body.

One other device, U.S. Pat. No. 5,100,130 to Shoebrooks (1992), shows an abdominal exercise apparatus that supports the upper and lower body during abdominal exercises. The handles the exerciser uses to engage the device are mounted on its surface, so the user can accidentally lie on one causing discomfort or possible injury. Intensity is increased by the user grabbing handles either permanently attached in different locations or by detaching and moving one pair of handles to different locations on the device to vary resistance. If the handles are permanently attached to the device, several must be provided to accommodate users of varying ability levels. This increases the cost of the device. If there is only one pair of detachable handles the cost will be lower but the handles can be misplaced when unattached. Separate pads and supports can be attached to the device adding to its cost and assembly time.

Similarly, U.S. Pat. No. 5,125,883 to Shoebrooks (1992) discloses a method to use his device, described previously. According to the claimed method, the user engages the device by gripping the handles mounted on a board, which keeps the board against the user thus supporting the head, neck and upper back during an abdominal crunch. This method can be awkward if the user has to conform to predetermined locations of handles on the device. Moveable handles make the method adaptable to various users, but changing the position of the handles between users is complicated, inconvenient and time consuming.

Another device has the exerciser lie supine on a padded board that is hinged under the receives the head and pulls up by contracting the abdominal muscles. The upper portion of the board that is hinged is connected via a cable to a weight stack, as the user pulls the board up the weight is lifted from the stack. This devise does a good job in both supporting the head and neck and safely applying external resistance. However, this device is expensive to manufacture. Also, being heavy and bulky, it is not very portable.

All the known abdominal exercise devices and methods heretofore known suffer from one or more of the following disadvantages:

(a) The manufacturing of some of the prior art machines require expensive production facilities that include welding and painting departments. Also, the weight of the machines require that they be shipped on expensive trucking carriers instead of U.P.S. The price of these machines can run into thousands of dollars, and the weight of such machines does not allow easy portable movement.

(b) During some conditioning exercises it is required that the exerciser be on their hands and knees or lying on their side. The irregular shapes and surfaces of some of the prior art devices prevent them from being used as a cushioned support pad during these exercises.

(c) Some of the prior art devices do not allow for the safe and easy attachment and detachment of common dumbbells and other hand weights to increase resistance during abdominal exercises.

(d) Some of the prior art devices provide no way to support the head, neck and upper back during the execution of trunk curl exercises other then the partial support offered by clasping the users hands behind their head.

(e) One prior art device and method uses complicated and inefficient handle placement to enable the user to engage the device and vary intensity.

OBJECTS AND ADVANTAGES

Accordingly, several objects and advantages of the present invention are:

(a) to provide an exercise device that will support the head, neck and upper back of the user while the user performs an abdominal crunch;

(b) to provide an exercise device that can be easily gripped by the user without having to attach separate handle means to the device;

(c) to provide an exercise device to which a user can easily attach external resistance to increase the intensity on the abdominal muscles;

(d) to provide an exercise device that when not being used to support the head, neck and upper back during an abdominal crunch, has a flat, cushioned surface for the user to lie or kneel on to perform conditioning exercises for other parts of the body;

(e) to provide an exercise device that is of a simple and inexpensive construction;

(f) to provide an exercise device that is lightweight and easily portable.

Further objects and advantages of the present invention will become apparent from the consideration of the drawings and ensuing description.

REFERENCE NUMERALS IN DRAWINGS

Figure 1:
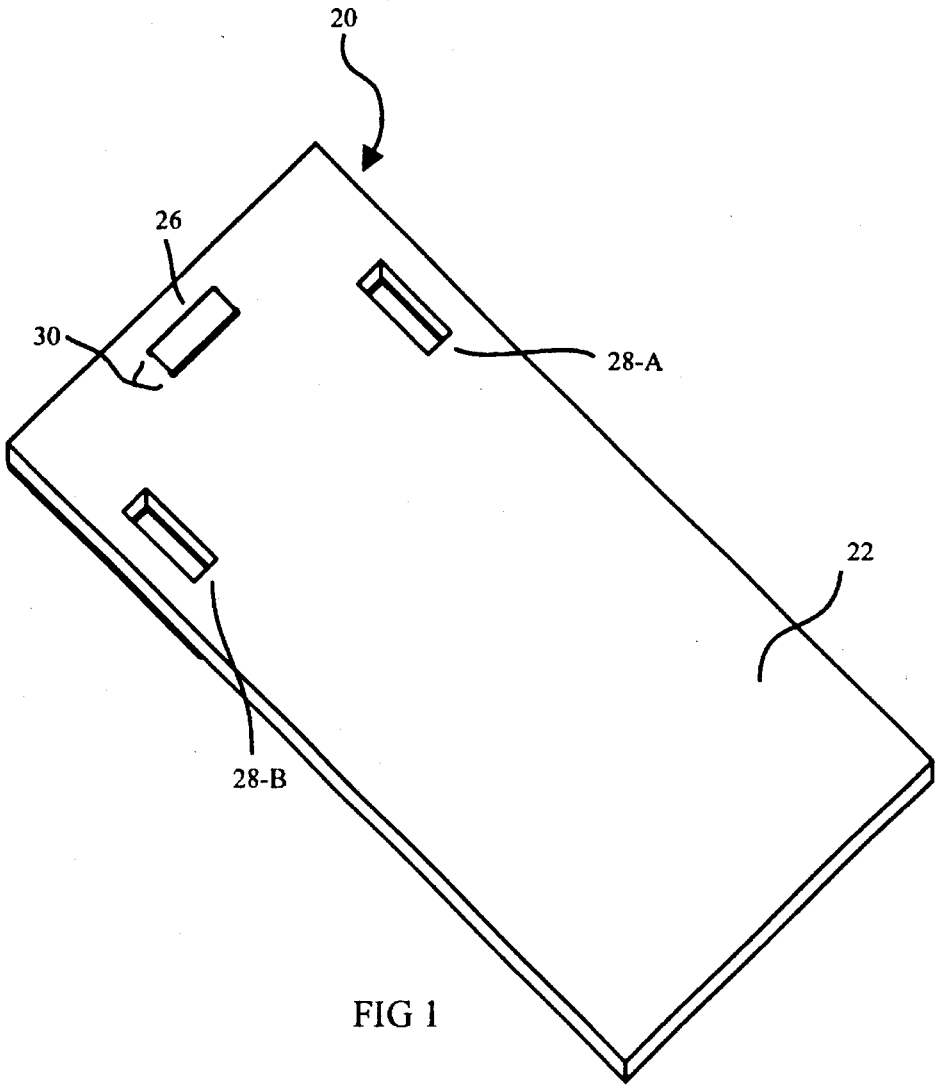
FIG. 1 is a plan view of the preferred embodiment of the present invention.

20 exercise devise
22 top layer
24 support panel
26 attachment strap
28-A through-hole
28-B through-hole
30 slots
32 bottom layer
34 dumbbell

DETAILED DESCRIPTION OF THE DRAWINGS

FIG. 1 shows a general view of the applicants invention.

Figure 2:
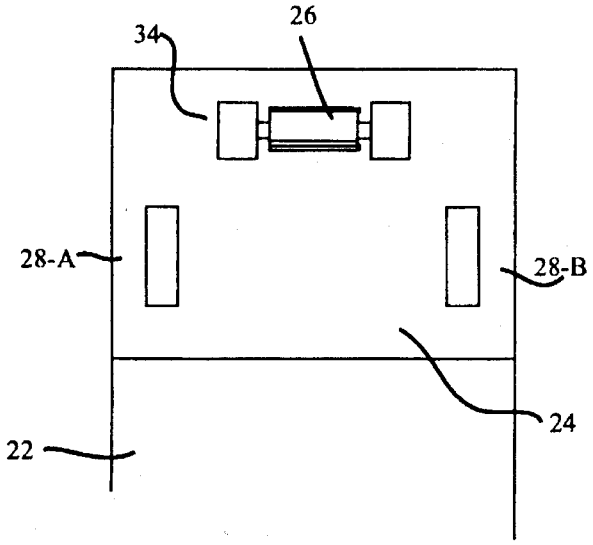
FIG. 2 is a rear view showing a dumbbell attached to the exercise device.

FIG. 2 (rear view) shows the top half of exercise device 20 to which dumbbell 34 is secured by the overlapping ends of attachment strap 26.

Figure 3:
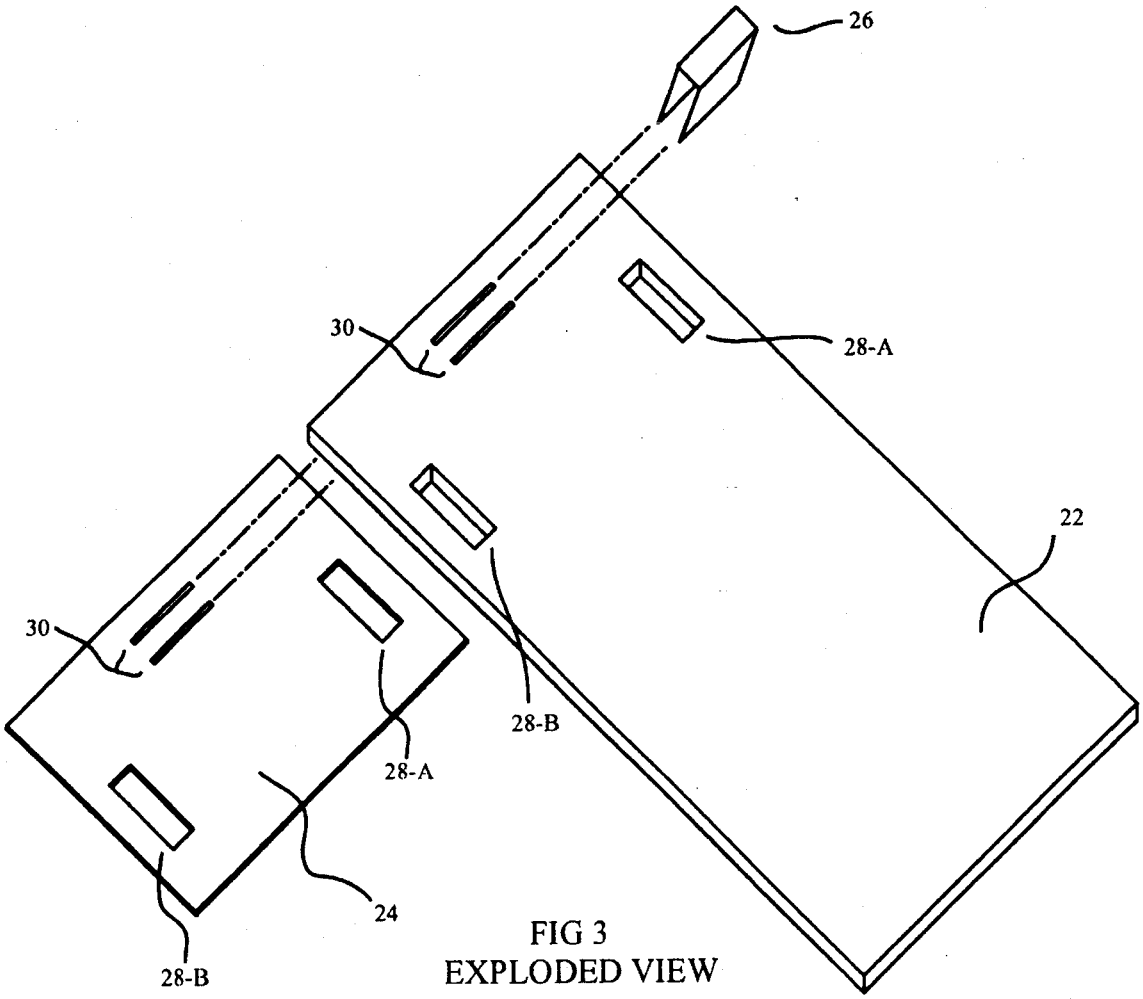
FIG. 3 is an exploded view showing portions of the exercise device shown in FIG. 1.

FIG. 3 (exploded view) illustrates a first, general embodiment of exercise device 20 of the present invention. Exercise device 20 has a top layer 22 formed of any suitable flexible, resilient, cushioned material. An example of such a suitable material is a closed cell polyethylene foam with a thickness of approximately 1 inch. Top layer 22 may be any desired length which preferably extends from above the head portion of the user to below the hip portion of the user. Preferably, top layer 22 is slightly wider than the width of the user.

Attached to one side of top layer 22 is support panel 24 that is made of any suitable lightweight, rigid or semi-rigid material. As an illustrative example, support panel 24 may preferably be approximately ⅛ inch thick and formed of polyethylene plastic. Support panel 24 is adhered to top layer 22 with any suitable adhesive. The preferred dimensions of support panel 24 are that its width is equal to that of the top layer 22 and it extends down to a sufficient length to support the head neck and upper back of the user without interfering with upward flexion of exercise device 20 during use. In a typical embodiment of exercise device 20, support panel 24 is attached to top layer 22 so that the top and side edges of support panel 24 are flush with those of top layer 22.

To vary the intensity of use of exercise devise 20, attachment strap 26 may be provided to secure a weight to the back of exercise device 20. The preferred construction of attachment strap 26 is that it is formed of any suitable strong, flexible material. As an example, heavy rip-stop nylon can be used. Strips of an adherent material (not shown) are secured to the overlapping ends of attachment strap 26 so that when overlapping ends are engaged the adherent material will hold the ends in place. Attachment strap 26 passes through two slots 30 located near the top of exercise device 20. External resistance is attached by separating the overlapping ends of attachment strap 26 and placing dumbbell 34 between them. Overlapping the ends of attachment strap 26 over dumbbell 34 temporarily secures it to the device. The external resistance is detached from the exercise devise 20 by separating the overlapping ends of attachment strap 26 and removing dumbbell 34. The weight of dumbbell 34 is variable.

Exercise devise 20 can be provided with through holes 28-A and 28-B near the users head to allow a user who can not or does not wish to grip the perimeter edge, with optional edges to engage exercise device 20. Through holes 28-A and 28-B should be at least large enough for a user to place his or her hands through to grip exercise device 20.

Figure 4:
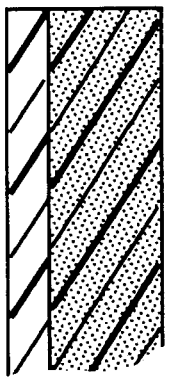
FIG. 4 is a partial end view of the exercise devise of FIG 1 showing examples of suitable materials.

FIG. 4 is a partial end view of the upper end of exercise devise 20 where top layer 22 is attached to support panel 24.

Figure 5:
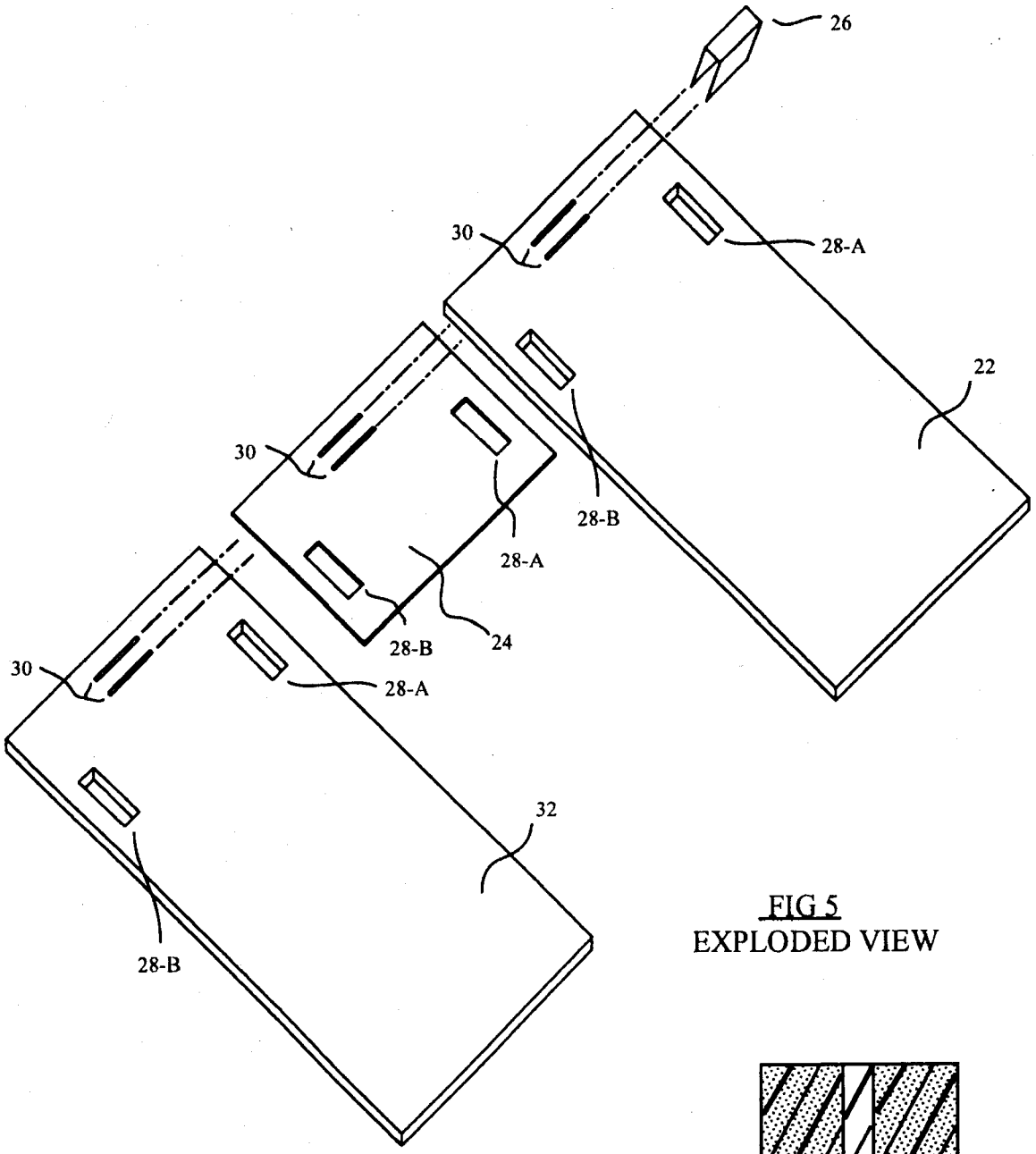
FIG. 5 is an exploded view of a second embodiment of the exercise device of the present invention.

FIG. 5 (exploded view) shows an alternate embodiment of exercise device 20. In this alternate embodiment exercise device 20 has a bottom layer 32 which may be formed of the same material as top layer 22. Bottom layer 32 may be adhered to exercise devise 20 to provide extra cushioning and to conceal support panel 24. Bottom layer 32 has the same dimensions as top layer 22. The placement and size of slots 30 and through holes 28-A and 28-B on bottom layer 32 are the same as on top layer 22 and support panel 24.

Figure 6:
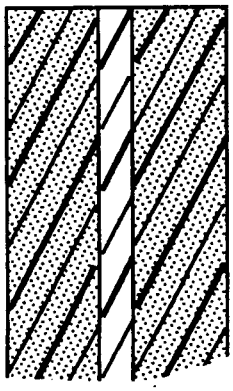
FIG. 6 is a partial end view of the exercise devise of FIG. 4 showing examples of suitable materials

FIG. 6 shows a partial end view of the alternate embodiment of exercise device 20 in FIG. 5.

Figure 7:
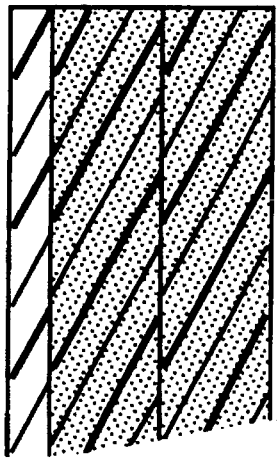
FIGS. 7–9 are partial end views of the exercise device showing various layering combinations of suitable materials.
Figure 8:
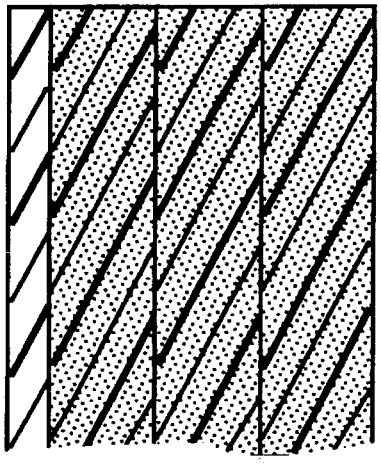
Figure 9:
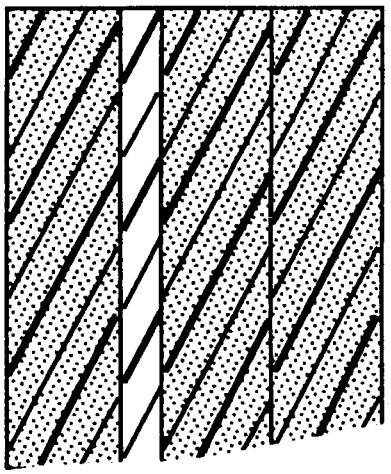

Additional embodiments are shown in FIGS. 7, 8 and 9; in each case a partial end view is provided showing that there are various possibilities with regard to additional layers of cushioned material and the relative disposition of support panel 24 between or behind the layers. FIG. 7 shows an alternate embodiment of exercise device 20 with an extra layer of the lightweight, flexible, resilient and cushioned material adhered to the upper surface of top layer 22. FIG. 8 shows another embodiment of exercise device 20 with two layers of the cushioned material adhered to top layer 22. FIG. 9 shows an additional embodiment of exercise device 20 with one layer of cushioned material adhered to top layer 22 and another layer of the cushioned material adhered to the back of exercise device 20.

OPERATION

In the use of exercise device 20 shown in FIG. 1, the user lies supine on the device, with the user's head positioned generally between through-holes 28-A and 28-B. The user's feet are drawn in towards the buttocks so that the user's knees are bent. The user engages exercise devise 20 either by gripping anywhere along the outside edge of the upper portion of the device that receives the head, or by gripping the edges exposed by through-holes 28-A and 28-B closer to the user's head. The user then concentrically contracts the abdominal muscles whereby the head portion of the device flexes upwardly into a concave configuration. During this flexing motion the head, neck and upper back portions are supported by exercise device 20.

To increase the intensity on the abdominal muscles, external resistance may be attached to the back of exercise device 20. The user may temporarily secure dumbbell 34 by overlapping the ends of attachment strap 26 over the weight thus holding it against the back of the device.

Exercise device 20 may also be used to cushion the user's body while performing other exercises that require the user to lie on his or her side or be up on the hands and knees.

SUMMARY, RAMIFICATIONS AND SCOPE

Accordingly, the reader will see that the exercise device of this invention can be used to support the head, neck and upper back of the user during an abdominal crunch. In addition, external resistance can be safely and easily attached to the device to increase intensity on the abdominal muscles during an abdominal crunch. Furthermore, the exercise device of the present invention has the additional advantages in that, it can be used to cushion a user's body from the floor while performing conditioning exercises for other parts of the body;

it provides a variety of convenient gripping positions without the addition of external handle means;

it is easily portable due to its light weight; and it provides an effective abdominal exercising devise that is both easy and inexpensive to manufacture.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. An abdominal exercising device comprising: an elongated sheet of flexible resilient cushioning material having a length, a width, an upper surface and a bottom surface, said length further comprising a first end and a second end, said width further comprising a right and a left side, said length of said elongated sheet extending at least from above the head portion of a user to below the hip portion of a user while lying in a supine position.

a support panel of a substantially flat and rigid configuration, a means for securing said flat panel to said bottom surface of said elongated sheet adjacent said first end thereof, said support panel being dimensionally configured wherein said width of said panel is of a predetermined dimension which extends substantially said width of said elongated sheet, and said panel extends a length from substantially the first end of said elongated sheet sufficient a length to support the head neck and upper back, of a user, without interfering with upper flexion of the exercise device during use, and;

handle means, said handle means positioned adjacent a first end of said elongated sheet, on right and left sides thereof, said exercise device being constructed to be normally flat in configuration and bendable into an upwardly curved configuration by movement of a user lying in a supine position thereon and gripping said handle means to contract and shorten the abdominal muscles while the users head neck, shoulders and back are supported by said exercise device.

2. An exercise device as claimed in claim 1 comprising: a means to releasably attach a weight means to said elongated sheet, adjacent said first end thereof.

3. An exercise device as claimed in claim 2 comprising: a weight attached to said device by said means to releasably attach.

4. An exercise device as claimed in claim 1 wherein said handle means are comprised of a pair of aligned apertures passing through said sheet and said panel, near the first end of said elongated sheet.

5. An exercise device as claimed in claim 1 comprising: a second sheet with like physical properties, features and dimensions of said sheet, is attached to a surface of said sheet.

6. An exercise device as claimed in claim 5 comprising: a third sheet with like physical properties, features and dimensions of said sheet, is attached to a surface of said sheet.

* * * * *